US005490739A

United States Patent [19]

Olson

[11] Patent Number: 5,490,739

[45] Date of Patent: Feb. 13, 1996

[54] WINDOW DISPLAY PHOTO ALBUM

[76] Inventor: Kristin Olson, P.O. Box 127, Barrington, Ill. 60010

[21] Appl. No.: 435,892

[22] Filed: May 5, 1995

[51] Int. Cl.[6] ..... B42F 13/00

[52] U.S. Cl. ..... 402/79; 281/15.1; 281/38

[58] Field of Search ..... 402/79, 80 R; 281/3.1, 15.1, 21.1, 28, 38, 40; 40/156, 158.1, 159, 152

[56] References Cited

U.S. PATENT DOCUMENTS

| | | | |
|---|---|---|---|
| 3,797,146 | 3/1974 | Holes | 402/79 X |
| 3,797,152 | 3/1974 | Brandt | 402/79 X |
| 4,965,948 | 10/1990 | Ruebens | 402/79 X |
| 5,303,487 | 4/1994 | Olson . | |
| 5,316,404 | 5/1994 | Hensel | 402/79 |
| 5,437,514 | 8/1995 | Minch | 402/79 |

*Primary Examiner*—Willmon Fridie, Jr.
*Attorney, Agent, or Firm*—McHale & Slavin

[57] ABSTRACT

A photo album window display sheet and booklet for placement of display items within window frames. Each sheet is constructed from a single sheet of paper having a rectangular shape and divided into three sections. A first and second framing section includes at least one aperture in each section allowing for viewing of a display item. Pressure sensitive adhesive strips secure the display item to the aperture or to a common backing section. The backing section is hingedly attached to the second framing section which is hingedly attached to the first framing section. Upon positioning of the backing sheet between the framing sections, display items are securely held in position. Provision is made for attachment of the sheets to a conventional binder. Once assembled the sheet forms part of a photo album for viewing display items in a framed format.

20 Claims, 1 Drawing Sheet

WINDOW DISPLAY PHOTO ALBUM

FIELD OF THE INVENTION

This invention relates generally to photo albums and, more particularly, to an improved photo album having individual framing windows for mounting photographs.

BACKGROUND OF THE INVENTION

Photo albums are well known in the art for their use in storing and displaying photographs. Albums may be classified according to a particular occasion such as a wedding, graduation, birthday, picnic, and so forth. The actual use of the album can be as varied as the variety of pictures that may be taken. Photo albums come in a variety of sizes. Full size albums may be capable of holding 8×10 photos, wallet size albums fit conveniently in a person's handbag.

The types of mounting devices used to mount photographs within photo albums are as diverse as the aforementioned photo album sizes. One type of mounting device employs individual photo album sheets having a backing page covered with an adhesive and a plastic cover. In operation the plastic cover is lifted from the adhesive allowing placement of the pictures on the backing page. Low tack adhesive will not securely hold the plastic cover and allows dirt and dust to contaminate the adhesive. Many times the placement of the cover will result in wrinkles or creases which may require several tries before the cover is placed smoothly over the pictures. The sticky adhesive also makes placement of the pictures difficult. Placement of the pictures must be exact for movement can lessen the effectiveness. High tack adhesive requires careful placement as repositioning may result in torn pictures. Lines placed on the backing sheet may assist in picture alignment but distract from the pictures. Despite the type of adhesive, any space left between the pictures will become discolored with age. Also, with the passing of time the clear cover may start to crack.

Another type of photo album consists of thin plastic pockets having a slit opening for placement of pictures. The sharp edge of the photographs easily cuts through the plastic allowing the side edges to rip.

Another type of album simply consists of a plurality of blank pages placed within a binder. Pictures are attached to each page by way of corner tabs positioned along each corner of the picture. Each tab must be moistened and then carefully placed over the corner of each picture. The picture must be quickly placed in its position on the album page so as the backs of the tabs do not dry before adhesion. If the picture is placed crooked, the picture must be removed and each tab replaced. If the adhesive on the back of the tab is touched it may result in picture smudges unless the fingers are washed before handling of the pictures.

Still another problem with conventional photo albums is their limitation to insertion of photos. In many instances a person may like to include in a photo album items of an associated memory such as a child's first drawing, a ticket to a baseball game, a particular flower and so forth. For example, a photo album may have pictures of a person's venture to a baseball game and part of the memory is to include a ticket stub or portion of the printed program so as to maintain the memory provided with the photograph. In such instances, the aforementioned photo albums lead to disarray. Items of diverse size may not easily slide within their sleeves and should they be placed upon an adhesive backing, the adhesive is visible in viewing and susceptible to the previously mentioned discoloring.

Thus, what is needed in the art is an inexpensive photo album that provides for framing of the pictures and secures the pictures without need for corner tabs or exposed adhesive. It is, therefore, to the effective resolution of these problems that the present invention is directed.

SUMMARY OF THE INVENTION

The principle objective of the instant invention is to provide a simple and inexpensive window display photo album through provision of an improved photo album capable of framing individual photos.

In general the instant invention is comprised of a plurality of substantially rectangular single sheets of paper that fit into a binder. Each sheet has the ability to display photographs or other items of display in a framed format having two side surfaces divided into three sections.

A first framing section is provided with at least one aperture disposed therethrough, preferably the aperture is highlighted by an embossed frame embedded around the aperture. Transparent two sided pressure sensitive adhesive strips are positioned across an upper and lower portion of one side surface of the first framing section with removable cover sheets to maintain the adhesive in a sticky condition until used.

A second framing section is hingedly attached to the first framing section having at least one aperture disposed therethrough, preferably the aperture is highlighted by a frame embedded around the aperture. Transparent two sided pressure sensitive adhesive strips are positioned across an upper and lower portion of one side surface of the second framing section with removable cover sheets to maintain the adhesive in a sticky condition until used. A backing section is hingedly attached to said second section.

In operation, the adhesive covers are removed exposing the adhesive strips allowing placement of a photograph or other items of display across the apertures. Alignment lines can be placed around the apertures for ease of positioning, alternatively, the backing section may include embossed positioning lines that provide for alignment on either side of the backing sheet. The backing sheet is placed over the back of the second section which securely fastens to any exposed adhesive not consumed by the photograph. Closure of the second framing section by the backing section allows viewing of the photograph from a frontal surface of the sheet. The backing sheet is then folded over the first section securely fastening to any exposed adhesive that has not been covered by the photograph, and securely fastening the backing sheet in position. The photograph may then be readily viewed through the aperture from the frontal surface. The paper material accepts indicia allowing for identification of the item of display.

A plurality of through holes along one side edge of the first portion allows the device to be installed into a binder wherein each sheet is rotated allowing viewing of pictures on each side of the sheet. Through holes may be sized to allow the display sheets to be placed within a conventional binder having as many display sheets as desired. Plastic may also be used to cover an aperture providing protection for the item of display.

Thus an objective of the invention is to provide a consumer customized photo display album incorporating a means for securing an item of display therein for viewing through framed apertures.

Still another objective of the instant invention is to provide a means for aligning an item of display to assist the consumer with the exact centering of the item.

Yet another objective of the instant invention is to utilize a common tape adhesive for securing items of display and a backing sheet for concealment of the mounting mechanism.

Yet still another objective is to provide a photo album having multiple apertures for viewing wherein each aperture may be made of a diverse shape.

Still another objective is to provide a photo album wherein photographs may be mounted to the backside of apertures or to a common backing sheet.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Figure 1:
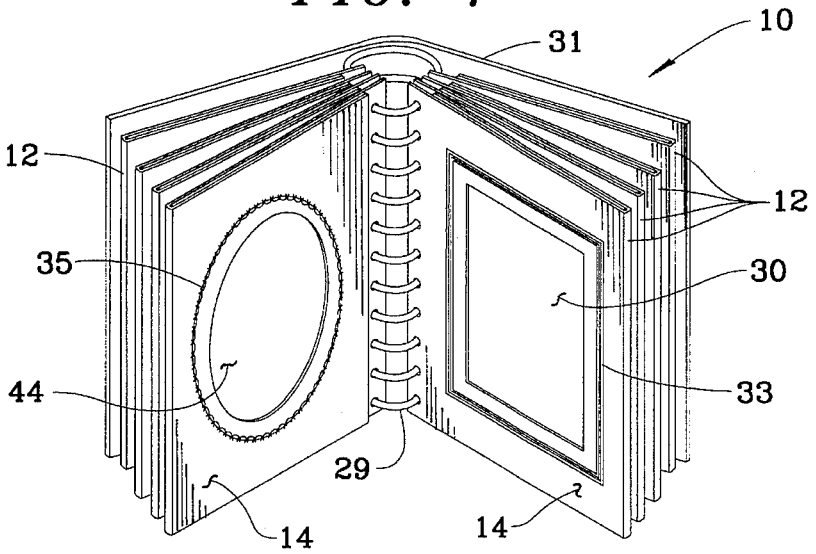
FIG. 1 is a perspective view illustrating the photo album of the instant invention.

As required, detailed embodiments of the present invention are disclosed herein, however, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Now referring to the Figures in general, shown is a photo album 10 having a plurality of substantially rectangular single sheet 12 constructed of paper, having a front surface 14 and a back surface 16. The sheet 12 is divided into a first framing section 18 having a first side edge 20 with an upper edge 22 lower edge 24 and fold line 26. A plurality of holes 28 is placed along first side edge 20 and is used to mount the sheet 12 to a binder ring 29. The binder ring 29 may consist of a spiral binder or operate as a conventional three ring binder wherein the sheets 12 are placed within the cover 31 of said conventional binder.

Framing section 18 includes a centrally disposed aperture 30 which allows for viewing from the front surface 14 of items attached to the back surface 16. The aperture 30 includes an outer edge 32 which provides a means for framing a photograph or display item. The framing means includes a square, rectangle, circle, oval, or any other shape providing an ornamental design to the picture framing. In addition, the framing may have a decorative border such as the rectangular border 33 or oval border 35 which enhances the aperture providing a framing aspect found on the more expensive framed pictures. The border is formed by stamping the immediate surrounding area providing a depressed area of paper. Alternatively the border may be formed by coloring of the surrounding area.

First transparent two-sided adhesive strip 34 is positioned across an upper portion of the back surface 16 with a second transparent two-sided pressure sensitive adhesive strip 36 positioned across a lower portion. When not in use the first adhesive strip 34 and second adhesive strip 36 employ removable covers 38 and 40 respectively. Removal of the covers 38, 40 expose the adhesive allowing for placement of a photograph or item of display thereon. It is noted that an item of display may include anything that fits within the perimeter of the aperture even if the item of display does not encompass the entire area provided by the aperture. Although not shown, a piece of clear plastic may be placed across the aperture opening and secured by attaching to a portion of said adhesive strips. The clear plastic will allow items such as a flower from projecting through the aperture and protect items from fingerprints or other objects coming in contact with the item of display. As will be described later in this specification, a backing sheet is then used to secure the item of display against the aperture, viewing is performed from the front surface of the sheet.

The second framing section 42 is defined by said upper edge 22 and lower edge 24 with the first fold line 26 forming one side edge bordered by a second fold line 43. The second framing section 42 includes a second centrally disposed aperture 44 with a third transparent two-sided pressure sensitive adhesive strip 46 positioned across an upper portion of the back surface 16 and a fourth transparent two-sided pressure sensitive adhesive strip 48 positioned across a lower portion of the back surface 16. Each adhesive strip 46, 48 includes covers 50, 52 to protect the adhesive when not in use.

An item of display 110' placed against adhesive strips 46 and 48 is secured thereto. To assist in the aligning of the item of display a plurality of geometrically drawn lines 54 may be located along the inner side surface of the framing section with each line extending equal distantly outwardly from the aperture 44. The first framing section 18 does not illustrate the use of geometrically drawn lines but it will be apparent to one of ordinary skill in the art that the lines may be used on either aperture to assist those in the lining of the items of display but are not necessary to practice the invention. Alternatively, the backing sheet 58 may have embossed lines, not shown. The embossed lines provide an alignment means without actual line drawing further allowing the backing sheet to be used for mounting of the pictures or items of display. It is noted that the lines are hidden from view upon installation.

This invention contemplates the use of double-sided adhesive tape. Double-sided adhesive tape is readily available and requires no elaborate manufacturing process for application.

However, adhesive applied by stamping or rolling is deemed within the scope of this invention. The adhesive strips may have a high tack for application against the back surface 16 of each framing section and a low tack for releasable application to the item of display. This allows the item of display to be changed should change be desired such as when one picture is substituted for another as conventionally done in photo albums. Alternatively, the adhesive strips may have a high tack for application against the back surface 16 of each framing section and a high tack for permanent application to said item of display wherein that item of display is never to be changed. Since the adhesive is hidden from view, the use of lower cost adhesive is permissible for if any yellowing occurs, it will not be noticeable from the viewing aperture.

A backing sheet 58 forms a third section and is defined by a second side edge 60, upper edge 22, lower edge 24, and second fold line 43. The backing sheet 58 has a width $d_1$ which approximates a width $d_2$ of second framing section 42. When the backing sheet 58 is folded over at fold line 43 it forms a single sheet in coupling with second framing section 42. First framing section 18 has a width $d_3$ that is greater than the width of sections 42 and 58 allowing an area for the holes 28 used in mounting of the sheet 12 to a binder 31 having rings 30.

Figure 2:
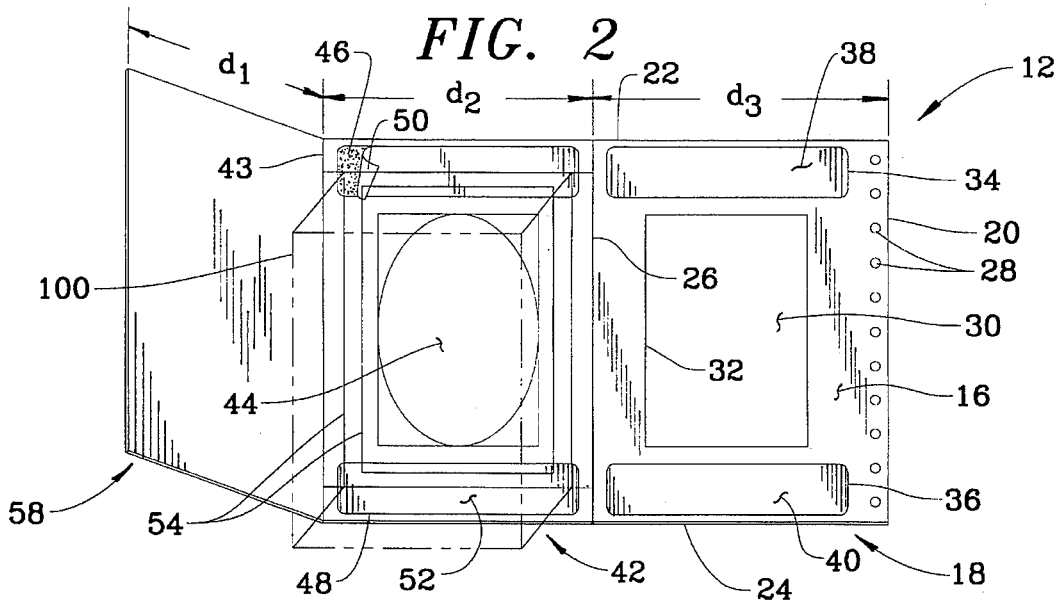
FIG. 2 is a perspective view illustrating the photo album sheet in an open position.

In operation, each fold line 26 and 43 allow for a hinge action between the first framing section 18 and second framing section 42, and the second 42 and third 58 section respectively. Referring to FIG. 2 adhesive covers 50 and 52 are removed from the third adhesive strip 46 and 48 exposing the adhesive allowing placement of a photograph 100 onto the adhesive. The alignment lines 54 allow for ease of positioning. Preferably the adhesive is transparent allowing the alignment lines 54 to be viewed through the adhesive. The backing sheet 58 is folded at fold line 43 allowing the upper edge 22 and lower edge 24 to remain in parallel disposition between sections 58 and 40. Thus the backing sheet 58 is placed over the item of display 100, after it has been attached to the adhesive strips 46 and 48, wherein the inner surface 16 securely fastens to any exposed adhesive that has not been consumed by the item of display 100, securely fastening the backing sheet in position.

Figure 3:
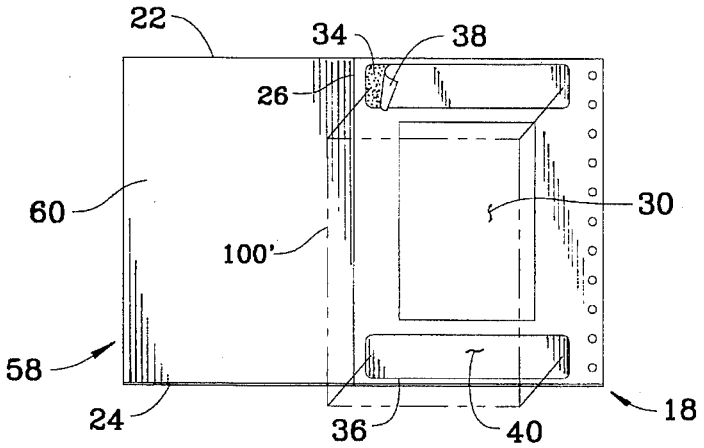
FIG. 3 is a perspective view with the backing sheet folded over one aperture.

Closure of the second framing section by the backing section 58 may be readily viewed by reference to FIG. 3. Adhesive covers 38 and 40 are removed exposing adhesive strip 34 and 36 allowing placement of a photograph 100' onto the adhesive. The first section 18 is shown without the use of the optional alignment lines. The backing sheet 58 is then folded at fold line 26 allowing the upper edge 22 and lower edge 24 to remain in parallel disposition between sections 18 and 58. Thus the backing sheet 58 is placed over the item of display 100' after it has been attached to the adhesive strips 34 and 36, wherein the inner surface 60 securely fastens to any exposed adhesive that has not been consumed by the item of display 100', securely fastening the backing sheet in position.

Item of display 100' may then be readily viewed through aperture 30 when viewed from the frontal surface 16. Item of display 100 is also viewed through aperture 44 when viewed through the frontal surface 16. The plurality of through holes 28 allow the device to be rotated as a single sheet. The photo album window display sheet 12 may be placed within a conventional binder 31 having as many display sheets 12 as desired.

It is to be understood that while I have illustrated and described certain forms of my invention, it is not to be limited to the specific forms or arrangement of parts herein described and shown. For instance, each sheet may have a plurality of apertures for framing multiple pictures on a single sheet of paper. It will be readily apparent to those skilled in the art that various changes may be made without departing from the scope of the invention and the invention is not to be considered limited to what is shown in the drawings and described in the specification.

What is claimed is:

1. A photo album display sheet for use in securing personal items such as photographs for display through predefined window frames for placement in a photo album comprising: a substantially rectangular single sheet of paper having two side surfaces, said sheet divided into a first framing section defined by a first side edge, an upper edge, a lower edge and a first fold line of said sheet with at least one aperture disposed therethrough; means for coupling items of display for viewing through said aperture of said first framing section; a second framing section further defined by said upper edge, said lower edge, said first and a second fold line with at least one aperture disposed therethrough; means for coupling items of display for viewing through said aperture of said first framing section; a backing section further defined by a second side edge, said upper edge, said lower edge and said second fold line; means for coupling said backing sheet to said first framing section; and a means for securing said photo album sheet into a booklet having a plurality of similarly sized photo album sheets;

whereby items of display are positioned for viewing through said apertures and secured thereto, said backing section is then available to be folded at said second fold line wherein said means for coupling secures an item of display between said second framing and backing sections for visual display through said aperture of said second framing section, said backing section and said second framing member then available to be folded at said first fold line wherein said means for coupling secures an item of display between said first framing member and a rear portion of said backing sections for visual display through said aperture of said first framing section.

2. The photo album display sheet according to claim 1 wherein said first and second means for coupling is defined as adhesive strips.

3. The photo album display sheet according to claim 1, wherein an opposite side surface of said one side surface of said first and second framing section includes a means for framing said aperture.

4. The photo album display sheet according to claim 1 wherein each said aperture is substantially circular.

5. The photo album display sheet according to claim 1 wherein each said aperture is substantially rectangular.

6. The photo album display sheet according to claim 1 including a means for aligning an item of display over each said aperture.

7. A photo album display sheet using commercially available two sided tape for use in securing personal items for display through predefined window frames comprising: a substantially rectangular single sheet of paper having two side surfaces, said sheet divided into a first framing section defined by a first side edge, an upper edge, a lower edge and a first fold line with a first centrally disposed aperture therethrough; at least one adhesive strip positioned across a portion of one side surface of said first framing section having a removable cover sheet; a second framing section further defined by said upper edge, said lower edge, and said first and second fold lines with a second centrally disposed aperture therethrough; at least one adhesive strip positioned across a portion of one side surface of said second framing section having a removable cover sheet; a backing section further defined by a second side edge, said upper edge, said lower edge and said second fold line; and means for securing said sheet into a booklet having a plurality of similarly sized photo album sheets;

whereby removal of said cover sheets from said adhesive strips allows an item of display to be properly positioned over said apertures and secured thereto, said backing section is then available to be folded at said second fold line sealing an item of display between said second framing and backing sections for visual display through said second aperture, said backing section and said second framing member then available to be folded at said first fold line sealing an item of display between said first framing member and a rear portion of said backing sections for visual display through said first aperture.

8. The photo album display sheet according to claim 7 wherein said adhesive strips have a high tack for application against said side surface of each said framing section and a low tack for releasable application to an item of display and said backing section.

9. The photo album display sheet according to claim 7 wherein said adhesive strips have high tack for application against said side surface of each said framing section and high tack for permanent application to an item of display and said backing section.

10. The photo album display sheet according to claim 7, wherein an opposite side surface of said one side surface of said first and second framing section includes a means for framing said aperture.

11. The photo album display sheet according to claim 7 wherein each said aperture is substantially circular.

12. The photo album display sheet according to claim 7 wherein each said aperture is substantially rectangular.

13. The photo album display sheet according to claim 7 wherein said aperture includes a plastic film overlay.

14. The photo album display sheet according to claim 7 wherein said means for securing is further defined as a plurality of through holes placed along said side edge of said sheet for insertion into a binder ring.

15. The photo album display sheet according to claim 7 including a means for aligning to assist in positioning of the display items.

16. A photo album using commercially available two sided tape for use in securing personal items for display through predefined window frames comprising: a plurality of substantially rectangular single sheets of paper each having two side surfaces with each said sheet divided into a first framing section defined by a first side edge having a plurality of through holes, an upper edge, a lower edge, and a first fold line of said sheet with a first centrally disposed aperture therethrough; means for framing said first aperture of said sheet; a first transparent two sided pressure sensitive adhesive strip positioned across an upper portion of one side surface of said first framing section and a second transparent two sided pressure sensitive adhesive strip positioned across a lower portion of said one side surface of said first framing section, said adhesive strips protected by removable cover sheets; a second framing section further defined by said upper edge, said lower edge, said first fold line and a second fold line with a second centrally disposed aperture therethrough; means for framing said second aperture of said sheet; a third transparent two sided pressure sensitive adhesive strip positioned across an upper portion of one side surface of said second framing section and a fourth transparent two sided pressure sensitive adhesive strip positioned across a lower portion of one side surface of said second framing section, said adhesive strips protected by removable cover sheets; a backing section further defined by a second side edge, said upper edge, said lower edge and said second fold line; and a means for securing said plurality of sheets in a booklet form;

whereby removal of said cover sheets from said adhesive strips allows an item of display to be properly positioned over said apertures and secured thereto, said backing section is then available to be folded at said second fold line sealing an item of display between said second framing and backing sections for visual display through said second aperture, said backing section and said second framing member then available to be folded at said first fold line sealing an item of display between said first framing member and a rear portion of said backing sections for visual display through said first aperture.

17. The photo album according to claim 16 wherein each said aperture is substantially circular.

18. The photo album according to claim 16 wherein each said aperture is substantially rectangular.

19. The photo album according to claim 16 including a plurality of geometrically drawn lines located on said one side surface of each said framing section, said lines extending equal-distantly outwardly from said aperture.

20. The photo album display sheet according to claim 16 wherein said means for aligning is defined as embossed lines on said backing sheet, said lines visible on each side surface of said backing sheet.

* * * * *